US006648673B2

(12) United States Patent
Watanabe

(10) Patent No.: US 6,648,673 B2
(45) Date of Patent: Nov. 18, 2003

(54) ELECTRICAL CONNECTOR

(75) Inventor: Satoshi Watanabe, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/132,221

(22) Filed: Apr. 26, 2002

(65) Prior Publication Data

US 2002/0177350 A1 Nov. 28, 2002

(30) Foreign Application Priority Data

May 22, 2001 (JP) ..... 2001-152253

(51) Int. Cl.[7] ..... H01R 13/58
(52) U.S. Cl. ..... 439/457; 439/460
(58) Field of Search ..... 439/457, 676, 439/404, 417, 418, 460

(56) References Cited

U.S. PATENT DOCUMENTS 5,199,891 A * 4/1993 Reed ..... 439/98
5,762,518 A * 6/1998 Tanigawa et al. ..... 439/409
5,911,594 A * 6/1999 Baker, III et al. ..... 439/404

* cited by examiner

*Primary Examiner*—Alexander Gilman
(74) *Attorney, Agent, or Firm*—Kanesaka & Takeuchi

(57) ABSTRACT

An electrical connector comprises a housing (21); a plurality of terminals (22) arranged in the housing (21) and connected to a plurality of paired wires of a cable (C); a guide member (10) having a plurality of receiving channels (13) for guiding and supporting the paired wires. Each of the receiving channels (13) has a wide channel (14) for receiving each of the paired wires, a pair of narrow channels (15) for receiving a pair of untwisted wires of the each paired wire, and a branching channel (16) for joining the wide and narrow channels (14, 15).

6 Claims, 5 Drawing Sheets

ELECTRICAL CONNECTOR

BACKGROUND OF THE INVENTION

1. Field of the Invention

The present invention relates to electrical connectors and, more particularly, to an electrical connector for connecting a cable having paired wires.

2. Description of the Related Art

Japanese patent application Kokai No. 10-134903 discloses an electrical connector of this type. A cable having a plurality of wires, each pair of which are twisted to prevent the production of noise by an alternating magnetic field, is well known. It is preferred that the twisted condition of paired wires be kept closely to the terminals to be connected although the paired wires must be untwisted for connection.

The above electrical connector employs two members; that is, a guide plate and an arranging member. The guide plate has a plurality of apertures through which paired wires are put. The arranging member has a plurality of apertures through which untwisted wires are put.

In use, a length of outer jacket of a cable is removed. Each pair of twisted wires are put into the aperture of the guide plate. The projected paired wires are untwisted and the straightened wires are put into the apertures of the arranging member. Then, the projected straight wires are connected to the terminals of the connector.

However, the length of the straight wires supported by the arranging member is so large that the impedance at the terminal connection point is diturbed. Also, this connector requires both the guide plate and the arranging member, making it large. Further, it requires two operations to put wires simultaneously through both the small apertures of the two members arranged in the longitudinal direction of the wires. Especially, untwisted wires tend to strike the edges of the apertures, failing passing through the apertures.

SUMMARY OF THE INVENTION

Accordingly, it is an object of the invention to provide an electrical connector having only one member for guiding and supporting both paired and straight wires in small length to suppress the impedance disturbance and enabling to insert the paired and straight wires without difficulty.

According to the invention there is provided an electrical connector comprising a housing; a plurality of terminals arranged in the housing and connected to a plurality of paired wires of a cable; a guide member having a plurality of receiving channels for guiding and supporting the paired wires, wherein each of the receiving channels has a wide channel for receiving each of the paired wires, a pair of narrow channels for receiving a pair of untwisted wires of the each paired wire, and a branching channel joining the wide and narrow channels.

In use, a length of the outer jacket of a cable is removed to expose a plurality of paired wires, end portions of which are straightened, and the straightened portions, the paired portions, and the intermediate portions between them are put into the narrow, wide, and branching channels, respectively, of the guide member by pushing them into the channeles in the diametric directions. The single guide member supports both the paired and straight wires, minimizing the number of components, the size of the connector, and the assembling time. The length of the straight wires is so small that the impedance disturbance is minimized and the transition from the paire wires to the straight wires is so even that the electrical characteristics are made uniform.

It is preferred that at least one of the wide, narrow, and branching channels has an engaging shoulder at its edge to prevent the paired or straight wire from coming out of the one channel. The connector may comprise a movable member supported by at least one of the housing and the terminals for rotation between an open position wherein the straight wires projecting from the guide member are inserted into a space between the movable member and the terminals and a closed position wherein the movable member presses the cable against the terminals. It may further comprise a shield case that may be put over the housing when the movable member is at the closed position to cover the housing and the guide member. The shield case may be brought into contact with a wire shield of the cable. The shield case may have a gripping portion that is deformed on a wire shield of the cable.

DESCRIPTION OF THE PREFERRED EMBODIMENTS

Figure 1A:
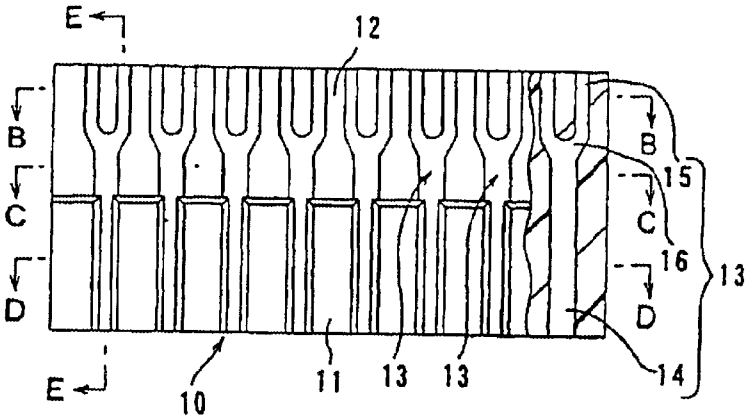
FIG. 1(A) is a plan view, partially in section, of an electrical connector according to an embodiment of the invention.
Figure 1E:
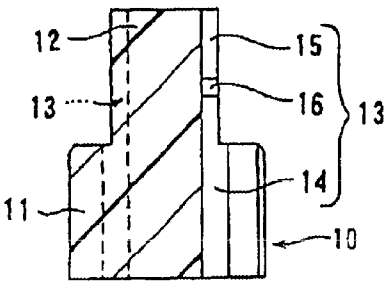
FIG. 1(E) is a sectional view taken along line E—E of FIG. 1(A)
Figure 1B:
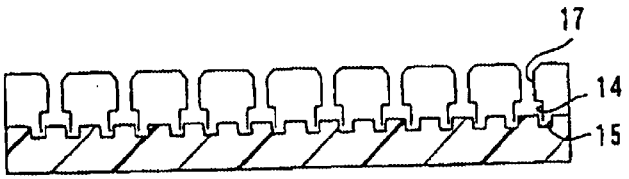
FIG. 1(B) is a sectional view taken along line B—B of FIG. 1(A)
Figure 1C:
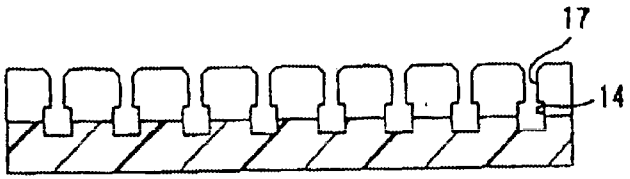
FIG. 1(C) is a sectional view taken along line C—C of FIG. 1(A)
Figure 1D:
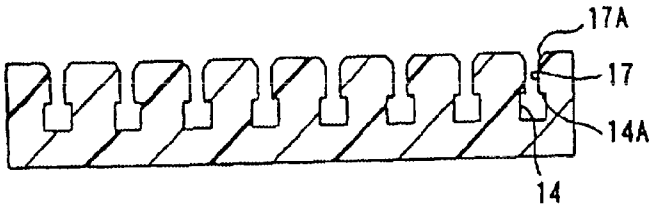
FIG. 1(D) is a sectional view taken along line D—D of FIG. 1(A)

In FIGS. 1(A)–(E), a guide member 10 holds wires of a cable and pair wires in arrangement. It is made of a plastic material in the form of a block. As best shown in FIG. 1(E), it has a thick section 11 and a thin section 12 and a symmetrical form so that FIGS. 1(B)–(D) show only one side thereof.

A plurality of receiving channels 13 are provided in each face of the guide member 10. Each receiving channel 13 consists of a wide section 14, a pair of narrow sections 15, and a branching section 16. The wide section 14 has a width sufficiently large to accommodate pair wires of a cable. It is preferred that the width is sufficiently large to press-fit the pair wires therein so that the wiede section 14 exerts a squeezing force on the pair wires. This wide section 14 extends upwardly from the bottom end of the guide member 10 (FIG. 1(A)) to a midpoint between the thick and thin sections 11 and 12. The narrow sections 15 extend downwardly from the top end and communicate with the wide section 14 via the Y-shaped branching section 16. The width of the narrow section 15 is sufficiently large to receive a straight wire of the pair wires. It is preferred that it is so large that the narrow section 15 exerts a squeezing force on the wire therein. As best shown in FIG. 1(D), each wide section 14 has a pair of upper engaging shoulders 14A, forming a neck or guiding portion 17 with upper tapered edges 17A for facilitating insertion of the pair wires.

Figure 2:
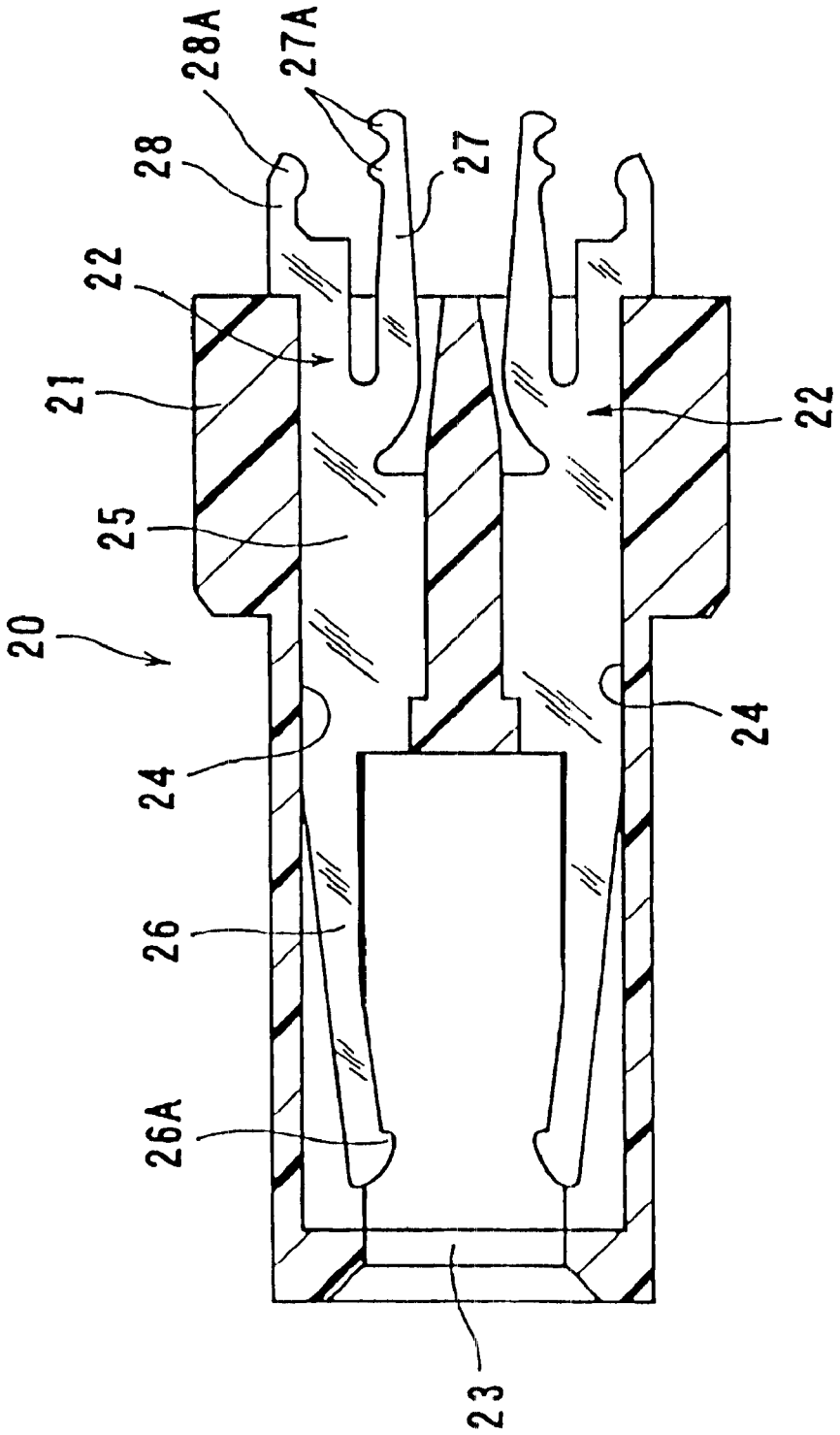
FIG. 2 is a sectional view of a connector body for the electrical connector.

In FIG. 2, a connector body 20 comprises a housing 21 and a plurality of terminals 22 provided in the housing 21. The housing 21 has a symmetric form and the terminals 22 are provided in symmetry. The housing 21 has a receiving cavity 23 extending rearwardly from its front face to receive a mating connector and a plurality of upper and lower terminal slots 24 extending forwardly from its rear face and arranged in parallel to the drawing sheet. The arranging pitch of the terminal slots 24 is equal to the arranging pitch of the narrow sections 15 in the guide member 10.

The terminals 22 are made by stamping a metal sheet and maintain flat surfaces. Each terminal 22 has a fixing section 25 that is press-fitted into the terminal slot 24 for retention, a spring contact arm 26 extending forwardly from the fixing section 25 and having a contact portion 26A, a spring connection arm 27 extending rearwardly from the fixing section 25 and having a pair of connection blades 27A, and a support arm 28 extending rearwardly from the fixing section 25 and having a circular support portion 28A. The spring contact and connection arms 26 and 27 are flexible in a plane along the drawing sheet.

Figure 3:
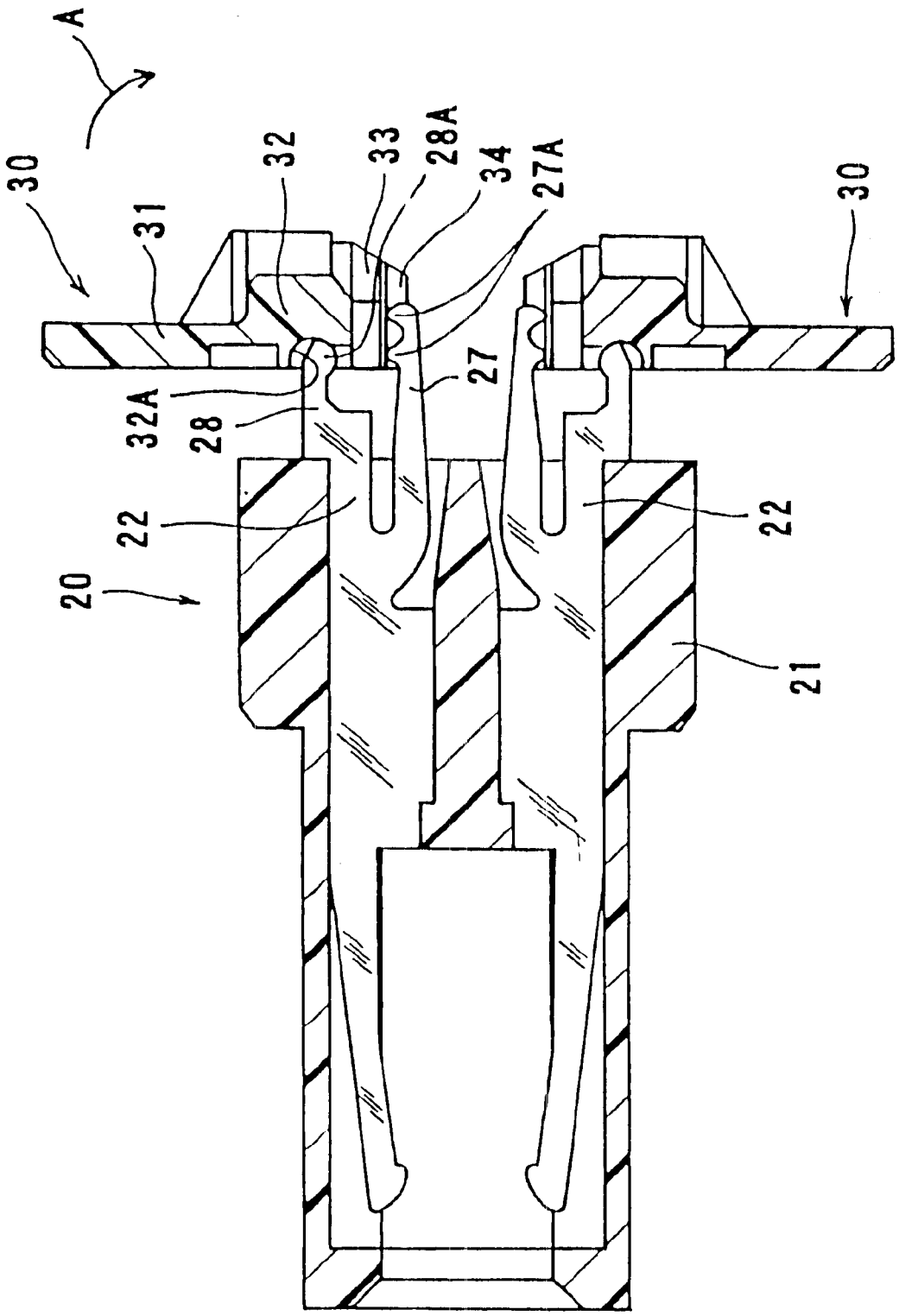
FIG. 3 is a sectional view of the connector body equipped with a pair of movable members.

In FIG. 3, a pair of movable members 30 are attached to the connector body 20. Each extends in the direction perpendicular to the drawing sheet and has a lever or operation section 31 and a bearing section 32 with a bearing surface 32A supported by the support portion 28A for rotation. The operation section 31 is rotatable between the closed position (FIG. 3) and the open position where it is turned in the direction A about the support portion 28A to the horizontal sate. The movable member 30 has a plurality of wire slots 33 at positions corresponding to the pressure portions 27A of the terminals 22 and a terminal slits 34 into which the pressure portions 27A are placed. The movable members 30 are provided symmetrically for the upper and lower terminal arrangements.

The connector is assembled as follows.

Figure 4:
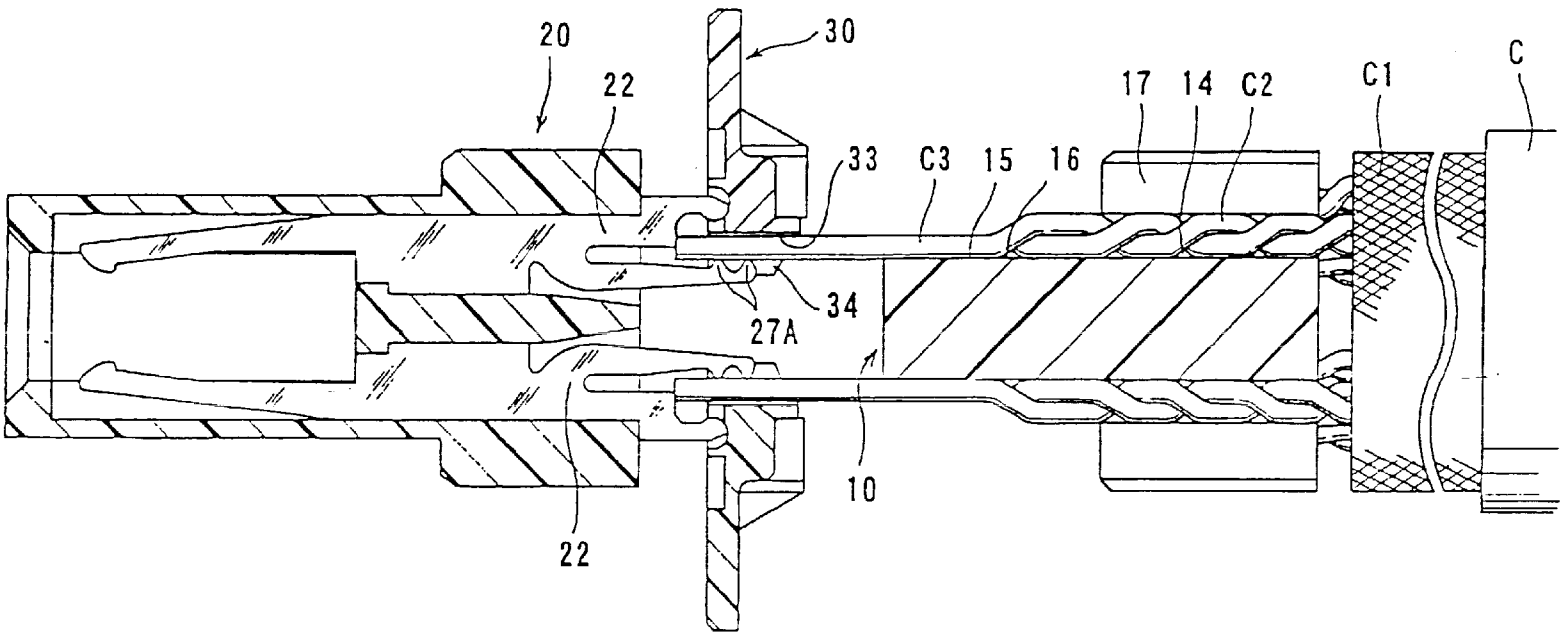
FIG. 4 is a sectional view of the connector body into which cable wires are put by means of a guide member.

(1) In FIG. 4, a predetermined length of outer jacket of a cable C is removed to expose a wire shield C1 and a plurality of pired wires C2. The end portions C3 of each pair of wires are untwisted and straitened.

(2) The paired wires C2 and the straight wires C3 are pushed into the wide and narrow channels 14 and 15, respectively, of the guide member 10 by providing the paired wires C2 along the guiding edges 17 and pushing them into the wide channels 14 while pushing the straight wires C3 into the narrow channels 15 via the branching channel 16. Under this condition, the engaging shoulders 14A prevent the paired wires C2 from coming out of the channels. The straight wires C3 project from the front end of the guide member 10 by a predetermined length and arranged at regular intervals.

(3) The straight wires C3 of the guide member 10 are inserted simultaneously into the wire slots 33 of the movable member 30 at the closed position such that they are opposed to the pressure blades 27A of the corresponding terminals.

Figure 5:
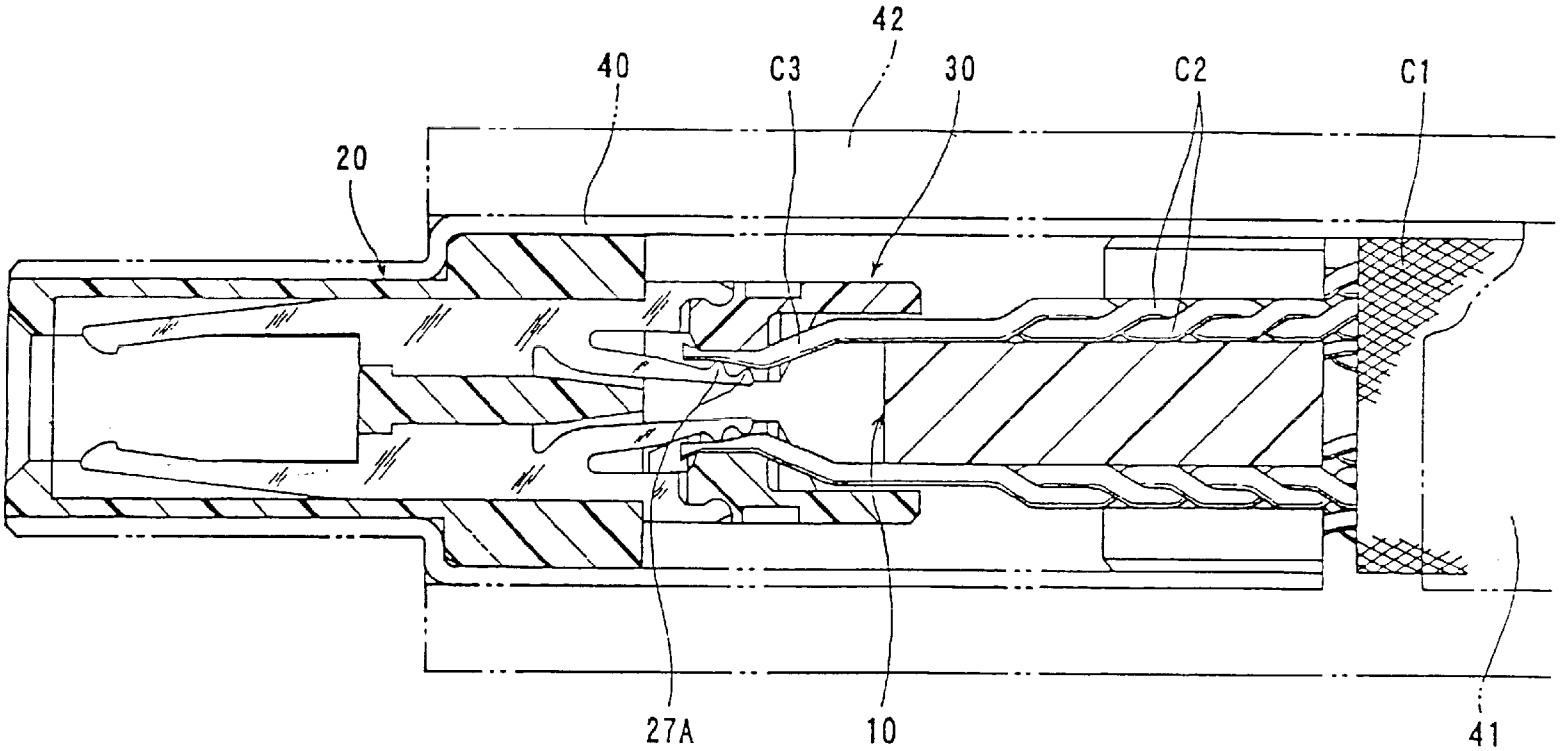
FIG. 5 is a sectional view of the electrical connector in which the movable members are closed.

(4) In FIG. 5, the movable member 30 is turned over to the closed position so that each straight wire C3 is pressed against the pressure blade 27A, which penetrates the insulation of the wire for contact. Thus, the cable C is connected electrically to the terminals 22 (contact under pressure).

(5) Then, the shield case 40 is put on the housing 21 from left-hand side such that it covers the guide member 10 and firmly supports both the connector body 20 and the guide member 10. It has a U-shaped gripping tabs 41 that are crimped on the wire shield C1 to support the cable C.

(6) Finally, a cover member 42 is put on the shield case 40 to complete the assembling.

It is preferred that the wide channels for paired wired are longer than the narrow channels for straight wires. In other words, the narrow channels should be short so that the paired wires are kept as long as possible to prevent disturbance of the impedance. The invention is not limited to the illustrated embodiment but many modifications thereto are possible within the sprit of the invention. For example, the receiving channels may be made in only one of the faces of a guide member. A plurality of guide members may be provided one upon another by employing a proper method for connecting the terminals. The invention is not concerned with the connection between a cable and the terminals.

As has been described above, according to the invention, the wide and narrow channels are provided in the guide member for receiving paired and straight wires so that the length of the paired wires may be kept long to minimize disturbance of the impedance. The paired wires are separated in the same manner by the branching channels so that the electrical characteristics are kept even. The guiding member makes not only the connector compact but also it possible to insert the paired and straight wires into the channels in the radial direction rather than the longitudinal direction of the wires.

What is claimed is:

1. An electrical connector comprising:

a housing;

a plurality of terminals arranged in said housing at regular intervals and connected to a plurality of paired wires of a cable;

a guide member having a plurality of receiving channels extending in a direction of an extension of said cable for guiding and supporting said paired wires, each of said receiving channels having a wide channel for receiving each of said paired wires, a pair of narrow channels for receiving a pair of untwisted wires of said each paired wire, and a branching channel joining said wide and narrow channels, wherein said narrow channels are provided at regular intervals having a distance equal to that of said regular intervals of said terminals.

2. The electrical connector according to claim 1, wherein at least one of said wide, narrow, and branching channels has an engaging shoulder at its edge to prevent said paired or untwisted wire from coming out of said one channel.

3. The electrical connector according to claim 1, which further comprises a movable member supported by at least one of said housing and said terminals for rotation between an open position wherein said untwisted wires projecting from said guide member are inserted into a space between said movable member and said terminals and a closed position wherein said movable member presses said wires against said terminals.

4. The electrical connector according to claim 3, which further comprises a shield case to be put over said housing to cover said housing and said guide member when said movable member is at said closed position.

5. The electrical connector according to claim 4, wherein said shield case is brought into contact with a wire shield of said cable.

6. The electrical connector according to claim 4, wherein said shield case has a gripping portion that is deformed on a wire shield of said cable.

* * * * *